US007686070B2

(12) United States Patent
Chu et al.

(10) Patent No.: US 7,686,070 B2
(45) Date of Patent: Mar. 30, 2010

(54) HEAT EXCHANGERS WITH TURBULIZERS HAVING CONVOLUTIONS OF VARIED HEIGHT

(75) Inventors: Stanley Chu, Mississauga (CA); Alex S. Cheong, Mississauga (CA); Peter Zurawel, Mississauga (CA); Paul T. Mach, Mississauga (CA)

(73) Assignee: Dana Canada Corporation, Ontario (CA)

( * ) Notice: Subject to any disclaimer, the term of this patent is extended or adjusted under 35 U.S.C. 154(b) by 1273 days.

(21) Appl. No.: 11/119,222

(22) Filed: Apr. 29, 2005

(65) Prior Publication Data

US 2006/0243429 A1 Nov. 2, 2006

(51) Int. Cl.
*F28F 13/12* (2006.01)
*F28F 1/40* (2006.01)

(52) U.S. Cl. ..... 165/109.1; 165/170; 165/177

(58) Field of Classification Search ..... 165/109.1, 165/149, 170, 177, 183, 146, 166
See application file for complete search history.

(56) References Cited

U.S. PATENT DOCUMENTS 1,640,147 A 8/1927 Fedders et al.
2,060,936 A 11/1936 Haag, Jr.
2,289,163 A 7/1942 Andersen
2,345,331 A 3/1944 Dono et al.
2,360,123 A * 10/1944 Gerstung et al. ..... 165/166
2,439,775 A * 4/1948 Kenedy ..... 165/146
2,566,310 A * 9/1951 Burnset al. ..... 165/166
2,646,027 A * 7/1953 Ackerman et al. ..... 165/166
3,601,185 A * 8/1971 Rothman ..... 165/166
3,818,984 A * 6/1974 Nakamura et al. ..... 165/166
4,170,122 A 10/1979 Cowell
4,434,638 A 3/1984 Sivachenko
4,501,321 A * 2/1985 Real et al. ..... 165/153
4,510,786 A 4/1985 Strangward
4,570,700 A 2/1986 Ohara et al.
4,645,000 A 2/1987 Scarelletta
4,804,041 A 2/1989 Hasegawa et al.

(Continued)

FOREIGN PATENT DOCUMENTS

DE 10 2006 016 711 A1 10/2007

(Continued)

OTHER PUBLICATIONS

PCT International Search Report for PCT/CA2006/000688 Mailed Aug. 25, 2006.

(Continued)

*Primary Examiner*—Leonard R Leo
(74) *Attorney, Agent, or Firm*—Marshall & Melhorn, LLC

(57) ABSTRACT

A heat exchanger comprises at least one tube or plate pair defining a fluid flow passage which is reduced in height across a portion of its width. A turbulizer comprising a plurality of rows of convolutions is received inside the fluid flow passage in either the low pressure drop or high pressure drop orientation. The turbulizer includes convolutions of reduced height in order to at least partially fill the reduced-height portions of the fluid flow passage and thereby reduce bypass flow. In some preferred embodiments of the invention, heat exchanger tubes or plate pairs define fluid flow passages which are reduced in height along their edges, and the turbulizer is similarly reduced in height along its edges.

7 Claims, 14 Drawing Sheets

U.S. PATENT DOCUMENTS

| | | | | |
|---|---|---|---|---|
| 4,805,693 | A | 2/1989 | Flessate | |
| 4,815,532 | A | 3/1989 | Sasaki et al. | |
| 4,888,972 | A | 12/1989 | Rouse | |
| 4,945,981 | A * | 8/1990 | Joshi | 165/166 |
| 4,962,622 | A | 10/1990 | Albrecht et al. | |
| 4,981,170 | A | 1/1991 | Dierbeck | |
| 5,056,348 | A | 10/1991 | Albrecht et al. | |
| 5,107,922 | A | 4/1992 | So | |
| 5,207,083 | A | 5/1993 | Bongiovanni et al. | |
| 5,209,289 | A | 5/1993 | Haushalter | |
| 5,261,262 | A | 11/1993 | Wallis | |
| 5,417,280 | A | 5/1995 | Hayashi et al. | |
| 5,538,077 | A * | 7/1996 | So et al. | 165/170 |
| 5,560,424 | A | 10/1996 | Ogawa | |
| 5,560,425 | A * | 10/1996 | Sugawara et al. | 165/148 |
| 5,636,685 | A | 6/1997 | Gawve et al. | |
| RE35,890 | E | 9/1998 | So | |
| 6,006,430 | A | 12/1999 | Fukuoka et al. | |
| 6,032,503 | A | 3/2000 | Grippe | |
| 6,119,769 | A * | 9/2000 | Yu et al. | 165/109.1 |
| 6,125,925 | A | 10/2000 | Obosu et al. | |
| 6,138,354 | A | 10/2000 | Kobayashi et al. | |
| 6,189,607 | B1 * | 2/2001 | Hosoya et al. | 165/174 |
| 6,192,977 | B1 | 2/2001 | Dey et al. | |
| 6,273,183 | B1 | 8/2001 | So et al. | |
| 6,502,447 | B2 | 1/2003 | Adams et al. | |
| 6,513,586 | B1 * | 2/2003 | Haussmann | 165/177 |
| 6,513,587 | B2 | 2/2003 | Ali et al. | |
| 6,571,473 | B1 | 6/2003 | Nozaki et al. | |
| 6,640,886 | B2 | 11/2003 | Lamich | |
| 6,901,995 | B2 * | 6/2005 | Yamaguchi et al. | 165/152 |
| 2002/0074109 | A1 | 6/2002 | Rhodes et al. | |
| 2003/0066635 | A1 | 4/2003 | Rhodes et al. | |
| 2005/0006078 | A1 * | 1/2005 | Jeong | 165/170 |
| 2005/0016240 | A1 | 1/2005 | Zurawel et al. | |
| 2006/0011333 | A1 | 1/2006 | Emrich et al. | |
| 2009/0014164 | A1 | 1/2009 | Zobel et al. | |
| 2009/0014165 | A1 | 1/2009 | Zobel et al. | |
| 2009/0019689 | A1 | 1/2009 | Zobel et al. | |
| 2009/0019694 | A1 | 1/2009 | Zobel et al. | |
| 2009/0019695 | A1 | 1/2009 | Zobel et al. | |
| 2009/0019696 | A1 | 1/2009 | Zobel et al. | |
| 2009/0020277 | A1 | 1/2009 | Zobel et al. | |
| 2009/0020278 | A1 | 1/2009 | Zobel et al. | |
| 2009/0056927 | A1 | 3/2009 | Zobel et al. | |
| 2009/0218085 | A1 | 9/2009 | Rogers et al. | |

FOREIGN PATENT DOCUMENTS

| | | |
|---|---|---|
| JP | 04-262829 | 9/1992 |
| JP | 07-265985 | 10/1995 |
| WO | WO 2008/011115 A2 | 1/2008 |

OTHER PUBLICATIONS

English Abstract of Japanese Published Application No. 04-262829 Published on Sep. 18, 1992.
English Abstract of Japanese Published Application No. 07-265985 Published on Oct. 17, 1995.

* cited by examiner

HEAT EXCHANGERS WITH TURBULIZERS HAVING CONVOLUTIONS OF VARIED HEIGHT

FIELD OF THE INVENTION

The invention relates to heat exchangers and conductive inserts for use therein, and particularly to plate-type heat exchangers incorporating turbulizers having convolutions of varying height.

BACKGROUND OF THE INVENTION

Plate-type heat exchangers comprise at least one pair of spaced-apart plates sealed together at their margins. Each plate pair defines a fluid flow passage having an inlet opening and an outlet opening. In a typical heat exchanger, the edges of the fluid flow passage have a height which is less than the height at the center of the fluid flow passage. The reduction in height adjacent the edges may be due to the manner in which the plates are joined together and/or the edges of the plates may be somewhat rounded as in U.S. Pat. No. 5,636,685 to Gawve et al.

The fluid flow passage may contain a conductive insert to enhance heat transfer and to increase turbulence in the fluid flowing through the flow passage. These conductive inserts, which are also known as turbulizers, usually comprise strips of metal in which a plurality of convolutions are formed by stamping and/or rolling. The convolutions are usually of a uniform height and are preferably in contact with both plates of the plate pair to maximize heat transfer. Numerous types of turbulizers are known in the prior art. One type of turbulizer which may be used in vehicular oil coolers is the louvered fin described in U.S. Pat. No. 4,945,981 (Joshi) issued on Aug. 7, 1990. Another type of turbulizer for use in vehicular heat exchangers is the offset strip fin, examples of which are described in U.S. Pat. No. Re. 35,890 (So) and U.S. Pat. No. 6,273,183 (So et al.). The patents to So and So et al. are incorporated herein by reference in their entireties.

As illustrated in FIGS. 1 to 3 of Gawve et al., a turbulizer of constant height cannot fill the entire area of a fluid flow passage which is reduced in height adjacent its edges, while maintaining effective contact with the plates. This causes the formation of a fluid bypass B (FIG. 3 of Gawve et al.) adjacent the edges of the fluid flow passage, which lowers the efficiency of heat transfer. This problem is partially solved in Gawve et al. by indenting the fin walls to reduce their height adjacent their ends, thereby reducing the bypass area B' as shown in FIG. 7.

While the Gawve et al. patent addresses the problem of bypass flow, it is specific to corrugated fins extending transverse to the direction of fluid flow and having fin walls which extend across the entire width of the turbulizer. There remains a need to address the problem of bypass flow in heat exchangers using other types of turbulizers, such as the offset strip fins mentioned above.

SUMMARY OF THE INVENTION

In one aspect, the invention comprises a heat exchanger comprising: (a) at least one pair of plates which are joined together to define a hollow fluid flow passage between the plates, wherein the flow passage has a height and a width and extends along a fluid flow axis, wherein the height of the flow passage varies across its width, wherein the flow passage comprises at least one full-height area in which the height of the flow passage is at a maximum and at least one reduced-height area in which the height of the flow passage is less than the maximum height of the flow passage, and wherein the full-height and reduced-height areas are located adjacent to one another; (b) a turbulizer received inside the fluid flow passage, wherein the turbulizer comprises a plurality of convolutions arranged in at least one row, wherein the convolutions of each said row comprise a series of crests and troughs interconnected by side walls, and wherein the rows extend transverse to the fluid flow axis and the side walls extend along the fluid flow axis; wherein each of the rows includes convolutions of different heights, including at least one full-height convolution positioned in the full-height area of the fluid flow passage and having a height substantially the same as the maximum height of the flow passage, and including at least one reduced-height convolution positioned in the reduced-height area of the fluid flow passage and having a height which is less than the maximum height of the flow passage.

In another aspect, the invention comprises a heat exchanger comprising: (a) at least one pair of plates which are joined together to define a hollow fluid flow passage between the plates, wherein the flow passage has a height and a width and extends along a fluid flow axis, wherein the height of the flow passage varies across its width, wherein the flow passage comprises at least one full-height area in which the height of the flow passage is at a maximum and at least one reduced-height area in which the height of the flow passage is less than the maximum height of the flow passage, and wherein the full-height and reduced-height areas are located adjacent to one another; (b) a turbulizer received inside the fluid flow passage, wherein the turbulizer comprises a plurality of rows of convolutions, wherein adjacent ones of said rows are connected in side-by-side parallel relation to one another, wherein the convolutions of each said row comprise a series of crests and troughs interconnected by side walls, and wherein the rows extend parallel to the fluid flow axis and the side walls extend transverse to the fluid flow axis; wherein at least two adjacent rows are comprised of convolutions of different heights, including at least one row of full-height convolutions positioned in the full-height area of the fluid flow passage and having a height substantially the same as the maximum height of the flow passage, and including at least one row of reduced-height convolutions positioned in the reduced-height area of the fluid flow passage and having a height which is less than the maximum height of the flow passage.

In yet another aspect, the present invention provides a heat exchanger comprising: (a) at least one heat exchange tube defining a hollow fluid flow passage, wherein the flow passage has a height and a width and extends longitudinally along a fluid flow axis, wherein the height of the flow passage varies across its width, wherein the flow passage comprises at least one full-height area in which the height of the flow passage is at a maximum and at least one reduced-height area in which the height of the flow passage is less than the maximum height of the flow passage, and wherein the full-height and reduced-height areas are located adjacent to one another; (b) a turbulizer received inside the fluid flow passage; wherein each said heat exchange tube comprises an elongate upper plate and an elongate lower plate in sealed engagement with one another; wherein the upper plate comprises a longitudinally extending central portion and a pair of longitudinally extending edge portions provided along either side of the central portion, the central portion being raised relative to the edge portions; wherein the lower plate comprises a longitudinally extending central portion located opposite the upper plate; a pair of longitudinally extending edge portions extending from the central portion of the lower plate in a direction toward the upper plate, wherein the edge portions of the lower plate each have a proximal edge joined to the central portion of the lower plate and a distal edge proximate to one of the edge portions of the upper plate; and a pair of locking tabs, each of which extends from the distal edge of one of the lower plate end portions; wherein the locking tabs of the lower plate are folded into engagement over the edge portions of the upper plate and the plates are sealed together along areas of contact between the locking tabs and the edge portions of the upper plate.

In yet another aspect, the present invention provides a heat exchanger comprising: (a) at least one heat exchange tube defining a hollow fluid flow passage and having a top wall, a bottom wall and a pair of side walls, wherein the flow passage has a height and a width and extends longitudinally along a fluid flow axis, wherein the height of the flow passage varies across its width, wherein the flow passage comprises at least one full-height area in which the height of the flow passage is at a maximum and at least one reduced-height area in which the height of the flow passage is less than the maximum height of the flow passage, and wherein the full-height and reduced-height areas are located adjacent to one another; (b) a turbulizer received inside the fluid flow passage; wherein each said heat exchange tube comprises a pair of generally U-shaped sections, each having a bight portion and a pair of legs extending from the bight portion, wherein the bight portions form the side walls of the tube and the legs form the top and bottom walls of the tube; wherein the legs of each U-shaped section have free end portions, each of the end portions of a first one of the U-shaped sections being in sealed engagement with one of the end portions of a second one of the U-shaped sections, such that the top and bottom walls of the tube are each formed by one of the legs of the first U-shaped section and one of the legs of the second U-shaped section.

BRIEF DESCRIPTION OF THE DRAWINGS

Preferred embodiments of the invention will now be described, by way of example only, with reference to the accompanying drawings in which.

DETAILED DESCRIPTION OF PREFERRED EMBODIMENTS

Figure 1:
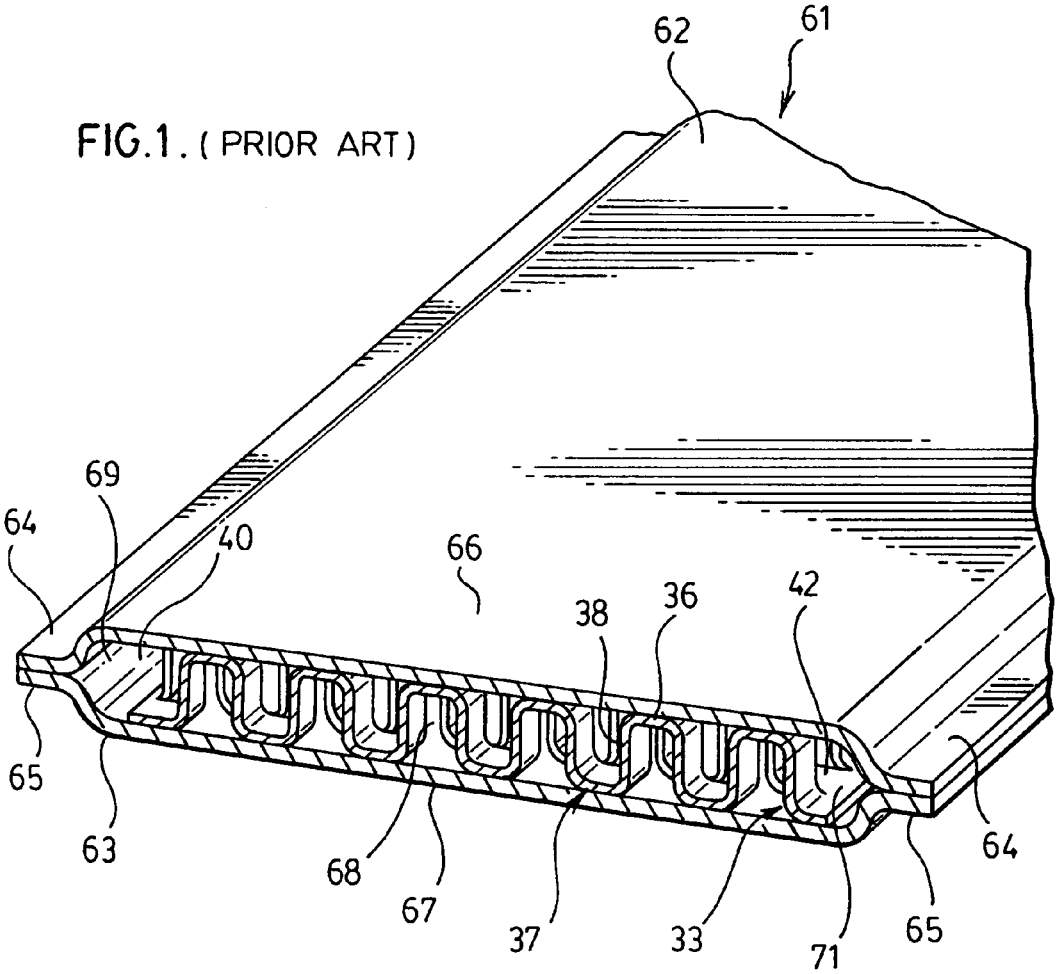
FIG.1. (PRIOR ART)
FIG. 1 is a cross-sectional perspective view of a plate pair provided with a prior art turbulizer.

The following is a description of a number of preferred heat exchangers, plate pairs and turbulizer strips according to the invention. Each heat exchanger described below comprises a pair of plates defining a fluid flow passage. The heat exchangers according to the invention may comprise a single pair of plates, for example as in the oil coolers described by Joshi and Gawve et al. Alternatively, the heat exchangers according to the invention may comprise a plurality of plate pairs extending between a pair of manifolds, such as the type described in the So et al. patent. In the heat exchangers according to the invention, a turbulizer is provided in the fluid flow passage. Unless otherwise stated below, the turbulizers used in the heat exchangers according to the invention may be simple corrugated fins as in the Joshi and Gawve et al. patents or may comprise offset strip fins as described in the So and So et al. patents mentioned above. Preferably, the turbulizers comprise offset strip fins.

Throughout the following description and claims, terms such as "top", "bottom", "upper" and "lower" are used to refer to the specific orientation of the plate pairs and turbulizers. It will be appreciated that these terms are used for convenience only. The tops and bottoms of the turbulizers are preferably indistinguishable from each other and the plate pairs do not necessarily have the orientation shown in the drawings when in use.

Problems associated with the prior art are now discussed below with reference to FIG. 1, showing a portion of a plate pair 61 of a heat exchanger provided with a prior art turbulizer 33 having convolutions of constant height, and with reference to FIGS. 2 and 3 which show the prior art turbulizer 33 in isolation.

The plate pair 61 is comprised of an upper plate 62 and a lower plate 63, with a turbulizer 33 located therebetween. Plates 62, 63 are arranged back-to-back and have joined peripheral flanges 64, 65. Plates 62, 63 also have raised central portions 66, 67 which define a flow passage 68 therebetween in which the turbulizer 33 is located.

It will be seen that the plates 62, 63 making up plate pair 61 are rounded adjacent to the peripheral flanges 64, 65 and therefore the flow passage 68 is reduced in height along its edges 69, 71.

Figure 2:
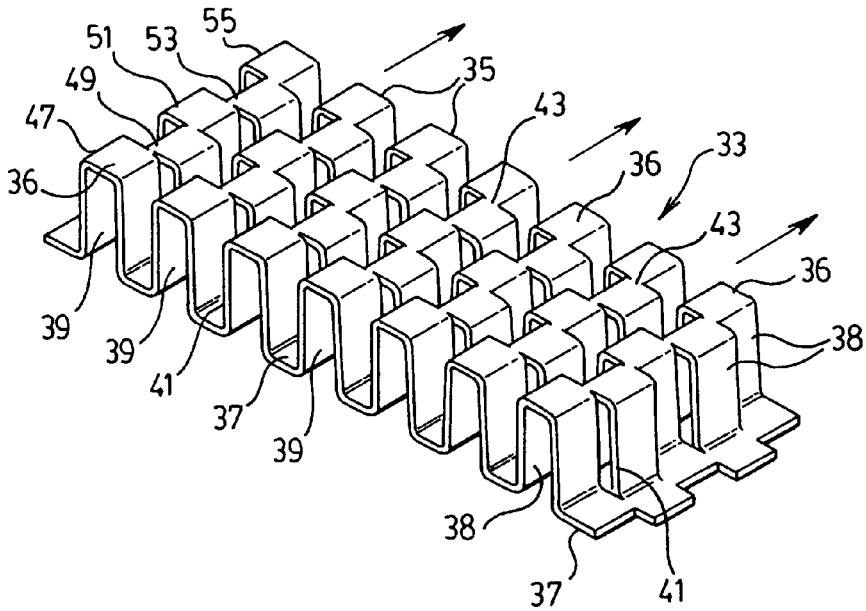
FIG. 2. ( PRIOR ART )
FIG. 2 is a perspective view of a portion of the turbulizer shown in FIG. 1.
Figure 3:
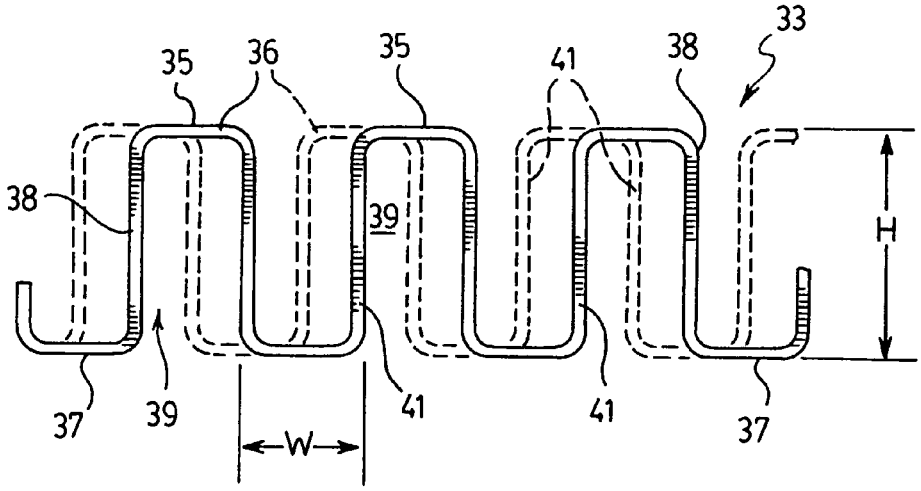
FIG. 3. ( PRIOR ART )
FIG. 3 is a front view of the turbulizer of FIG. 1, showing the relative orientations of overlapping convolutions in two adjacent rows.

The turbulizer 33 shown in FIGS. 1 to 3 is an offset strip fin similar to that shown in above-mentioned patent '890 to So. Turbulizer 33 is a planar member comprising a plurality of rectangular shaped convolutions 35 disposed in transverse rows shown at 47, 49, 51, 53 and 55. The rows are joined to one another through connecting portions 43. A complete turbulizer 33 would include a number of additional rows of convolutions. The convolutions 35 comprise a top surface portion 36, a bottom surface portion 37 (portions 36 and 37 are also referred to herein as "crests"), and side portions 38 which interconnect the top and bottom surface portions 36, 37. Convolutions 35 define apertures or flow passageways 39 opening in a direction transverse to the direction of rows 47, 49, 51, 53, 55. When a fluid such as oil flows through the flow passage 68 defined by plate pair 61, it will periodically encounter leading edges 41 associated with convolutions 35.

All the convolutions 35 of turbulizer 33 are of the same height H and the same width W (FIG. 3), the width being defined as the width of the top and bottom portions 36, 37 of corrugations 35. In order to maximize heat transfer, the top and bottom portions 36, 37 of corrugations 35 are preferably in contact with the central portions 66, 67 of the upper and lower plates 62, 63. The turbulizer 33 is arranged in the "low pressure drop" or "LPD" orientation, meaning that fluid flows through the openings defined by the convolutions, in a direction transverse to the rows. In this orientation, the fluid passing through the flow passage 68 encounters relatively little resistance to flow and therefore the pressure drop is relatively low.

As shown in FIG. 1, the turbulizer 33 is of a constant height which is substantially the same as the height of the flow passage 68 between the central portions 66, 67 of plates 62, 63. It is not possible to extend the turbulizer 33 to the edges 69, 71 of the flow passage 68 because the edges 69, 71 are reduced in height. Therefore the turbulizer 33 will not fit within these areas, at least not without being crushed. This causes the formation of bypass areas 40, 42 which are coincident with the edges 69, 71 of the flow passage 32. The resistance to fluid flow is at a minimum in these bypass areas 40, 42. Therefore, fluid preferentially flows through these areas and the efficiency of heat transfer is reduced.

Figure 4:
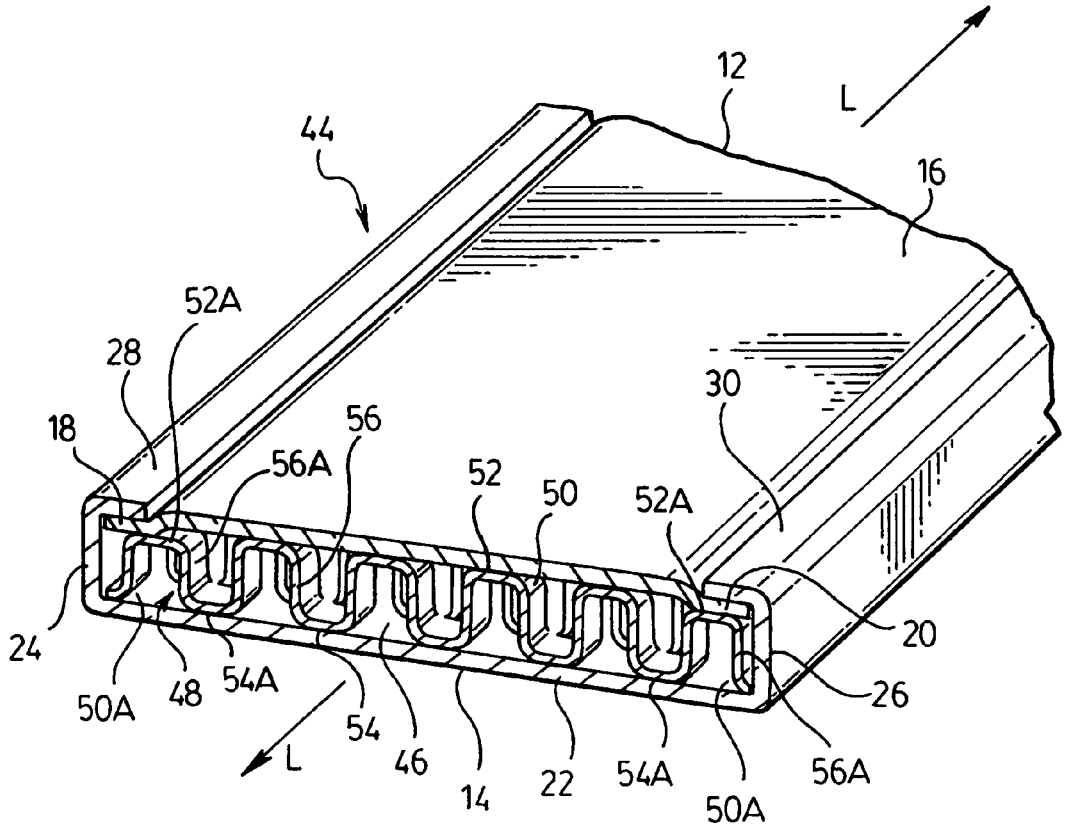
FIG. 4 is a cross-sectional perspective view of a plate pair provided with a turbulizer according to a preferred embodiment of the invention.

FIG. 4 illustrates a portion of a plate pair 44 for use in a heat exchanger according to a first preferred embodiment of the invention, and FIGS. 5 to 8 illustrate preferred turbulizers according to the invention. Plate pair 44 comprises an elongate upper plate 12 and an elongate lower plate 14. The upper plate 12 has a central portion 16 extending along longitudinal axis L and edge portions 18 and 20 extending longitudinally along either side of the central portion 16. The central portion 16 is raised relative to the edge portions 18 and 20, for reasons which will be discussed below.

The lower plate 14 comprises a longitudinal central portion 22 and comprises longitudinal edge portions 24 and 26 projecting at an approximately right angle from central portion 22, thereby forming side walls of the plate pair 44. The edge portions 24 and 26 are provided with locking tabs 28 and 30 which are bent down into locking engagement over the edge portions 18 and 20 of the upper plate 12. The tabs 28 and 30 mechanically lock the plates 12 and 14 together (as better shown in FIG. 4A) and provide surfaces along which a sealed connection can be made with the edge portions 18 and 20 of the upper plate. A sealed connection may preferably be provided by brazing the upper and lower plates 12 and 14 together so that a fillet of braze filler metal (not shown) is formed between the locking tabs 28 and 30 of lower plate 14 and the edge portions 18 and 20 of upper plate 12.

As shown in FIG. 4, the central portion 16 of upper plate 12 is raised relative to the edge portions 18 and 20 so that the locking tabs 28 and 30 of lower plate 14 are approximately coplanar with the central portion 16 of upper plate 12. This provides the plate pair 44 with a substantially flat upper surface which is free of projections. This is advantageous, for example where the ends of the plate pair 44 must fit into a rectangular slot of a header plate (not shown). Since the edge portions 18 and 20 are recessed relative to the central portion 16, the fluid flow passage 32 formed by the plate pair 44 is relatively higher in the middle than at its edges.

Figure 4A:
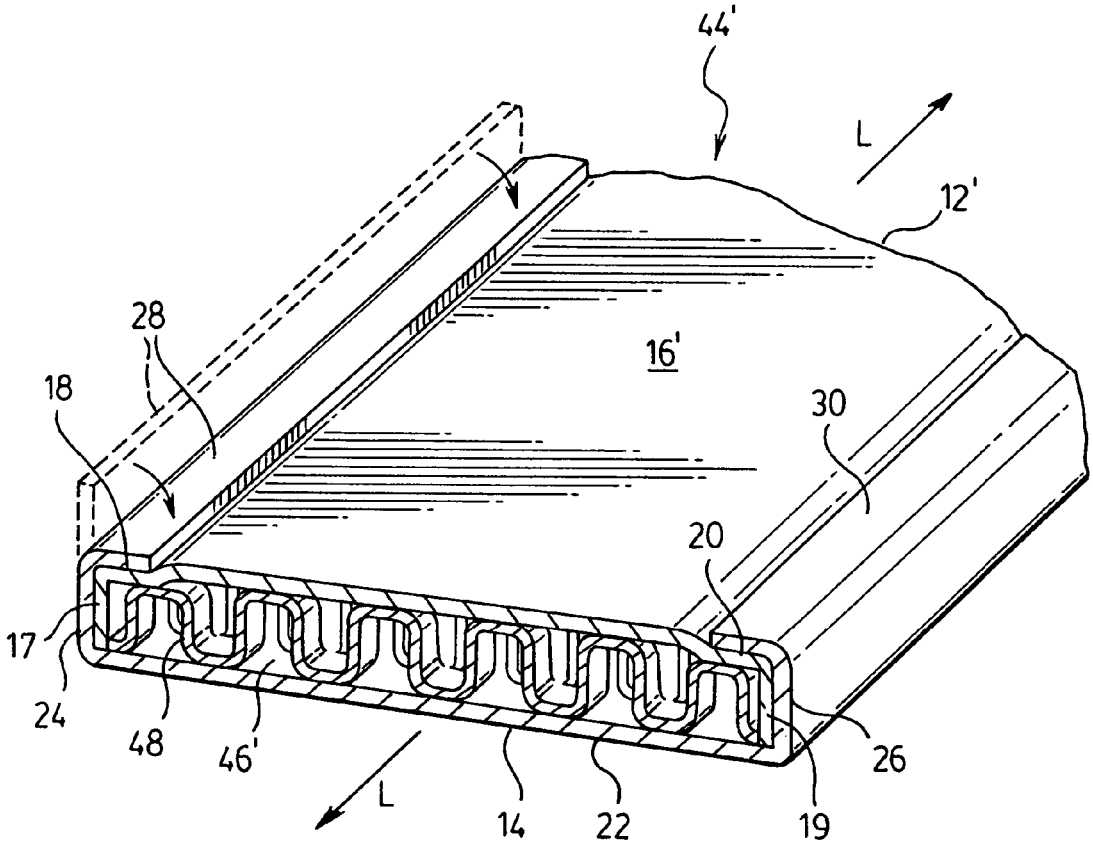
FIG. 4A is a cross-sectional perspective view of a modified version of the plate pair of FIG. 4.

FIG. 4A illustrates a plate pair 44' which is a modified version of plate pair 44 described above. Plate pair 44' includes an upper plate 12' having a central portion 16' extending along longitudinal axis L and edge portions 18' and 20' extending longitudinally along either side of the central portion 16'. The central portion 16' is raised relative to the edge portions 18' and 20'. The edge portions 18' and 20' are provided with downward extensions 17, 19 extending at an approximately right angle from the edge portions 18', 20' and preferably extending longitudinally along the entire length of upper plate 12'.

Plate pair 44' also includes a lower plate 14 which is identical to that of plate pair 44, having a central portion 22 and edge portions 24, 26 projecting at an approximately right angle from central portion 22, thereby forming side walls of the plate pair 44'. The edge portions 24, 26 are provided with locking tabs 28, 30 which, as shown in dotted lines in FIG. 4A, are initially upstanding and coplanar with the edge portions 24, 26, but which are bent downwardly in the direction of the curved arrows into engagement with the edge portions 18', 20' of the upper plate 12'. As shown in FIG. 4A, the downward extensions 17, 19 are of sufficient height such that their lower free ends (distal to the edge portions 18', 20') make contact with the central portion 22 of the lower plate 14 and are nested in parallel relation with the edge portions 24, 26 of the lower plate 14. The downward extensions 17, 19 provide the plate pair 44' with a double edge wall thickness for increased strength; provide increased surface area for braze joints; facilitate assembly by permitting the turbulizer to be inserted into one of the plates prior to assembly of the plate pair; and provide support for the edge portions 24, 26 of the lower plate 14 during the forming/locking operation.

Figure 5:
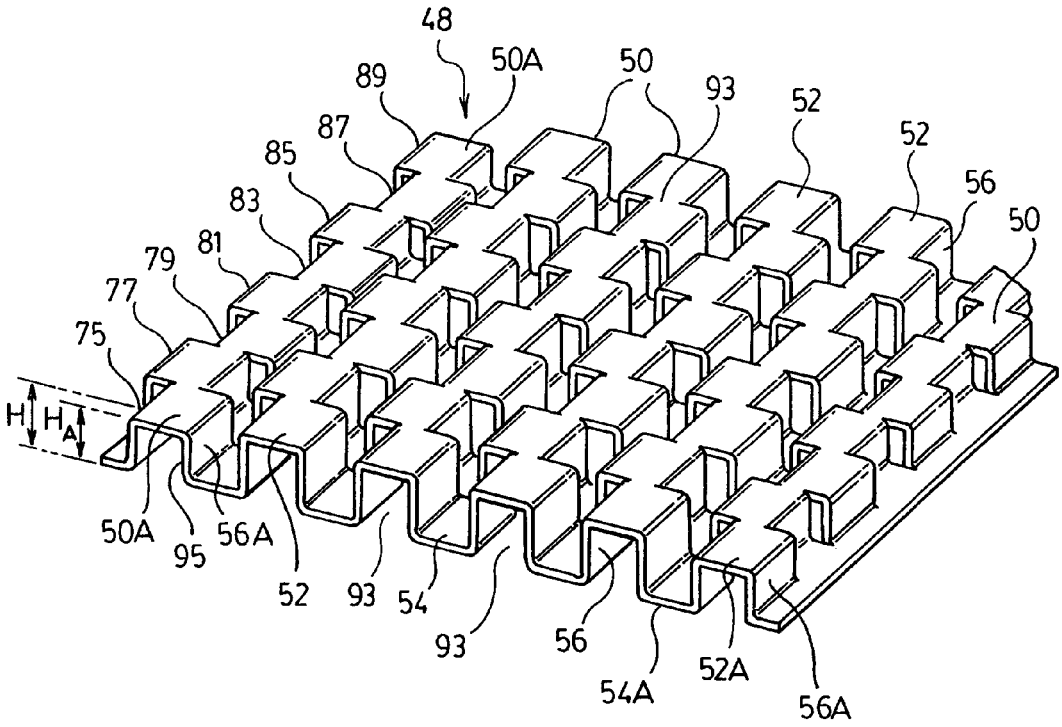
FIG. 5 is a perspective view of a portion of the turbulizer shown in FIG. 4.

The plate pairs 44 and 44' of FIGS. 4 and 4A each define a fluid flow passage 46, 46A in which a turbulizer 48 is provided. The turbulizer 48 is described below in relation to FIG. 4 only. The turbulizer 48 comprises an offset strip fin similar to the strip fin 33 described above, having a plurality of rectangular shaped convolutions 50 disposed in a plurality of transverse rows shown at 75, 77, 79, 81, 83, 85, 87 and 89 (FIG. 5). The rows are joined together through connecting portions 91. It will be appreciated that a complete turbulizer 48 would also include a number of additional rows of convolutions 50.

The convolutions 50 comprise flat top surface portions 52, flat bottom surface portions 54 and vertical side portions 56 which interconnect the top and bottom surface portions 52, 54. Convolutions 50 define apertures or flow passageways 93 opening in a direction transverse to the direction of the rows. When a fluid such as oil flows through the flow passage 46 defined by plate pair 44, it will periodically encounter leading edges 95 associated with convolutions 50.

The turbulizer 48 includes convolutions 50 of varying height. More specifically, each row includes a first plurality of convolutions 50 of width W and height H, wherein height H is substantially the same as the height of the flow passage 46 between the central portion 16 of upper plate 12 and the central portion 22 of lower plate 14. The convolutions of height H are located inward of the ends of the rows, such that the top and bottom surface portions 52, 54 of convolutions 50 make contact with the central portions 16 and 22 of the upper and lower plates 12 and 14.

Located at either end of each row is at least one convolution 50, labelled as 50A, having width $W_A$ and height $H_A$, wherein width $W_A$ is the same as width W and height $H_A$ is less than height H. Furthermore, height $H_A$ is substantially the same as the height of the flow passage 46 between the edge portions 18 and 20 of the upper plate 12 and the central portion 22 of lower plate 14. These convolutions 50A are comprised of top surface portions 52A, bottom surface portions 54A and side portions 56A. In the preferred embodiment shown in FIGS. 4 to 6, the side portions 56A are shorter than side portions 56 of convolutions 50, while the top and bottom surface portions 52A, 54A are the same width as top and bottom surface portions 52, 54 of convolutions 50. In addition, the bottom surface portions 54 and 54A are coplanar while the top surface portions 52A are reduced in height relative to top surface portions 52 in order to conform to the shape of the flow passage 46. Therefore, as shown in FIG. 4, the convolutions 50A occupy the areas referred to as bypass areas 40 and 42 of FIG. 1, with the top surface portions 52A of convolutions 50A in contact with the edge portions 18, 20 of upper plate 12, and with the bottom surface portions in contact with the lower plate 14.

Figure 6:
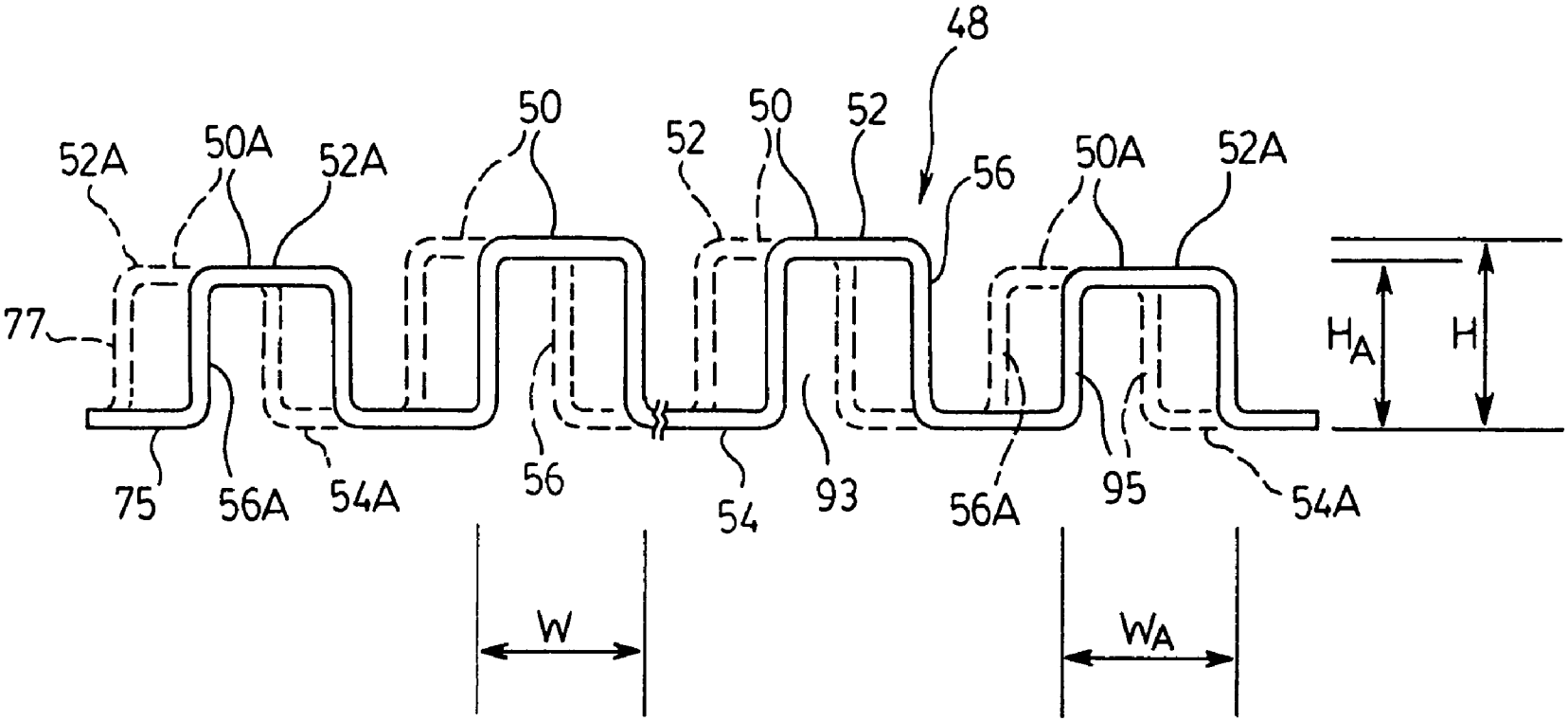
FIG. 6 is a front view of the turbulizer of FIG. 5, showing the relative orientations of overlapping convolutions in two adjacent rows.

The turbulizer 48 shown in FIGS. 4 to 6 shows only one reduced-height convolution 50A at the end of each row. However, it will be appreciated that more than one reduced-height convolution 50A may be provided at one or both ends of each row, depending on the configuration of the flow passage and the width of the convolutions 50. It will also be appreciated the reduced-height convolutions 50A may preferably be provided only at one end of turbulizer 48, depending on the configuration of the flow passage 46. It will also be appreciated that the reduced height convolutions at one end of the rows may differ in height and/or width relative to the reduced height convolutions at the other end of the rows.

Figure 7:
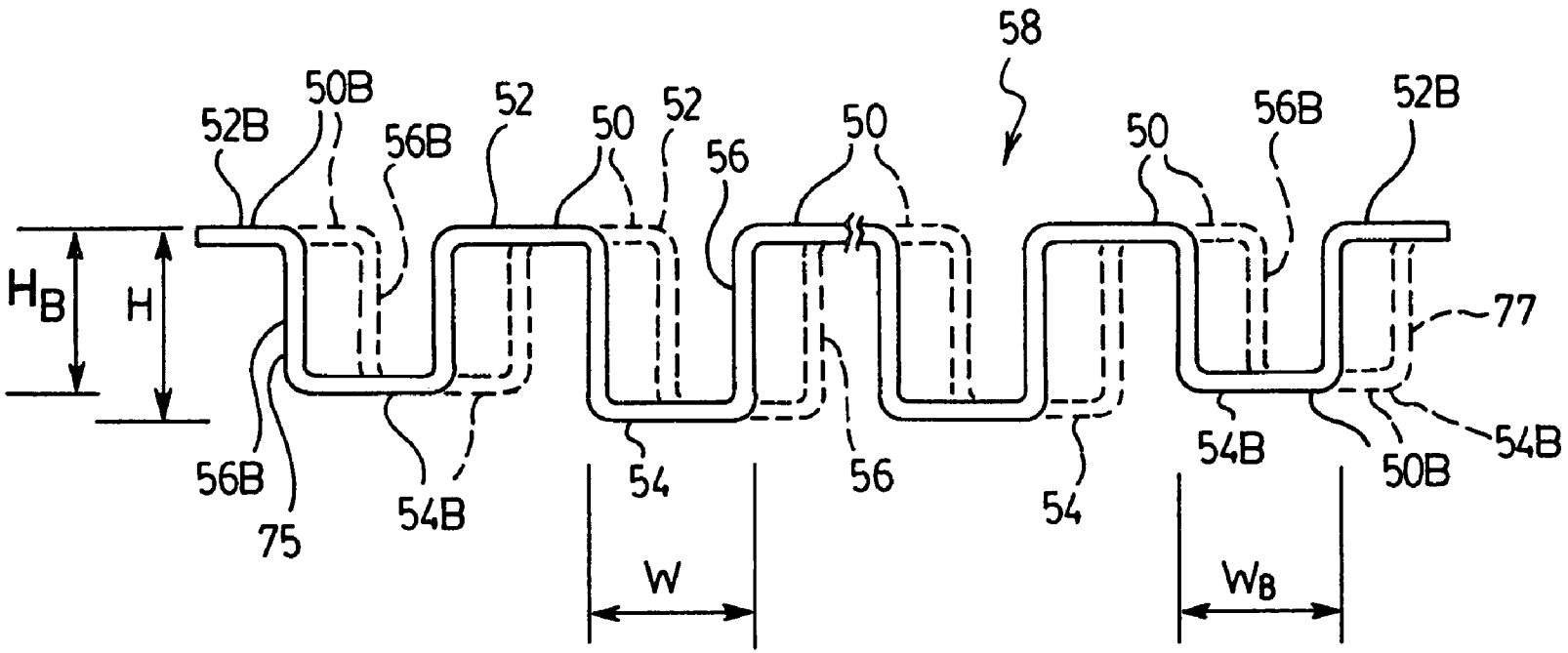
FIG. 7 is a front view of a first variant of the turbulizer of FIGS. 5 and 6, showing the relative orientations of overlapping convolutions in two adjacent rows.
Figure 8:
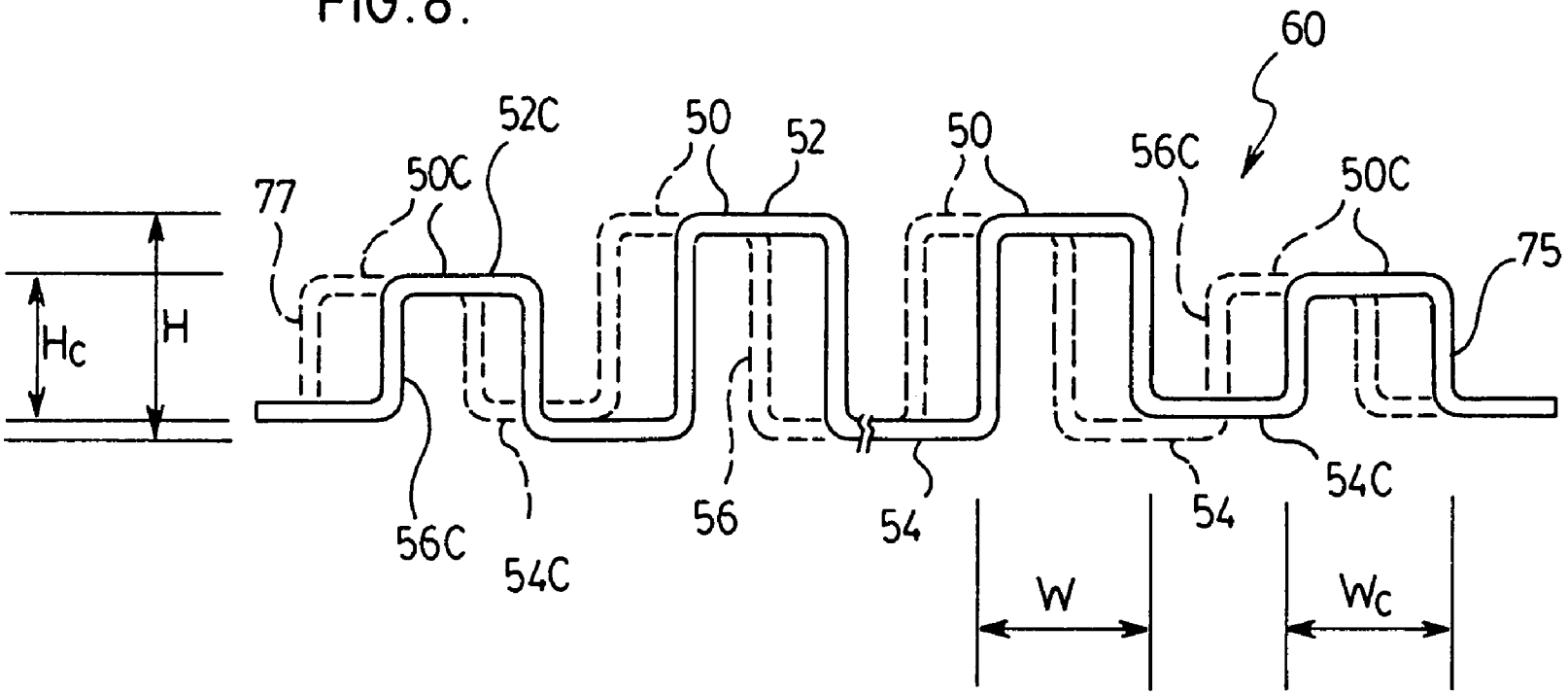
FIG. 8 is a front view of a second variant of the turbulizer of FIGS. 5 and 6, showing the relative orientations of overlapping convolutions in two adjacent rows.

FIGS. 7 and 8 illustrate two variants of the turbulizer shown in FIGS. 4 to 6, designed to fit flow passages of varying configuration, and like elements of these turbulizers are identified by like reference numerals. FIG. 7 illustrates two rows 75, 77 of a turbulizer 58. Each row comprises a plurality of centrally-located convolutions 50 having height H and width W. Located at either end of each row 75, 77 is at least one convolution 50B having width $W_B$ which is the same as width W and height $H_B$ which is less than height H. The convolutions 50B have side portions 56B which are shorter than side portions 56 of convolutions 50, and top and bottom surface portions 52B, 54B having the same width as top and bottom surface portions 52, 54 of convolutions 50. In addition, the top surface portions 52 and 52B are coplanar while the bottom surface portions 54B are elevated relative to top surface portions 54.

FIG. 8 illustrates two rows 75, 77 of a turbulizer 60. Each row comprises a plurality of centrally-located convolutions 50 having height H and width W. Located at either end of each row 75, 77 is at least one convolution 50C having width $W_C$ which is less than width W and height $H_C$ which is less than height H. The convolutions 50C have side portions 56C which are shorter than side portions 56 of convolutions 50, and top and bottom surface portions 52C, 54C which are narrower than top and bottom surface portions 52, 54 of convolutions 50. In addition, the top surface portions 52C are reduced in height relative to top surface portions 52 while the bottom surface portions 54C are elevated relative to bottom surface portions 54.

It will be appreciated that turbulizers 48 and 58 of FIGS. 6 and 7 could be modified by increasing or decreasing the widths of the top surface portions 52A, 52B and/or the widths of the bottom surface portions 54A, 54B thereof, thereby varying the pitch as well as the height of the convolutions 50A, 50B along the longitudinally extending edges of turbulizers 48, 58. It will also be appreciated that turbulizer 60 of FIG. 8 could be modified by either making the width of top surface portions 52C and/or bottom surface portions 54C the same as or greater than the width of top and bottom surface portions 52, 54.

It will be appreciated that the turbulizers 48 and 58 shown in FIGS. 6 and 7 are particularly useful where only one of the top or bottom wall of the plate pair converges toward the opposing top or bottom wall of the plate pair adjacent to the edges of the plate pair, as in FIG. 4. On the other hand, the turbulizer 60 shown in FIG. 8 is particularly useful where both the top and bottom walls of the plate pair converge toward one another adjacent to the edges of the plate pair, as in FIG. 1.

Figure 9:
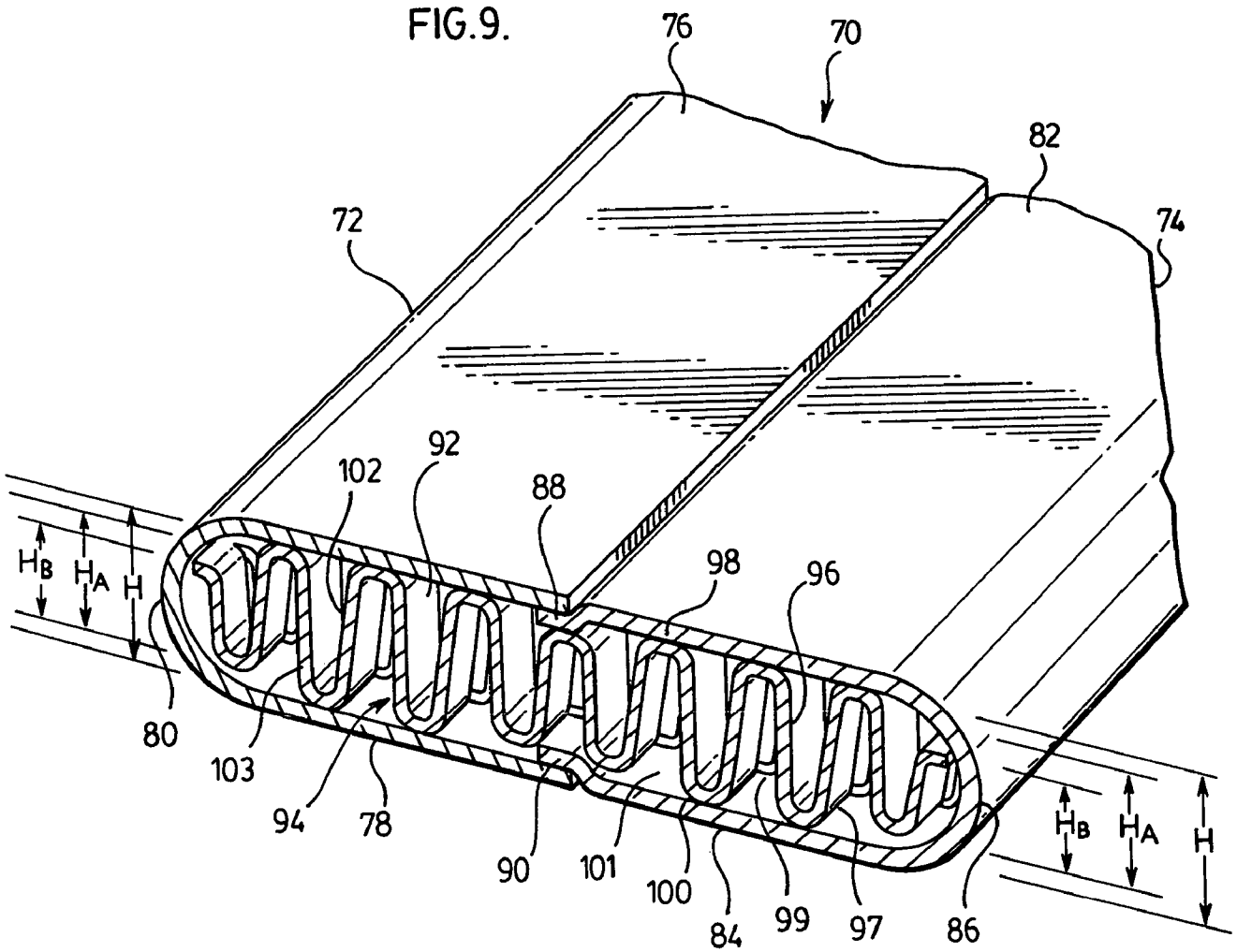
FIG. 9 is a cross-sectional perspective view of a plate pair provided with a turbulizer according to another preferred embodiment of the invention.
Figure 10:
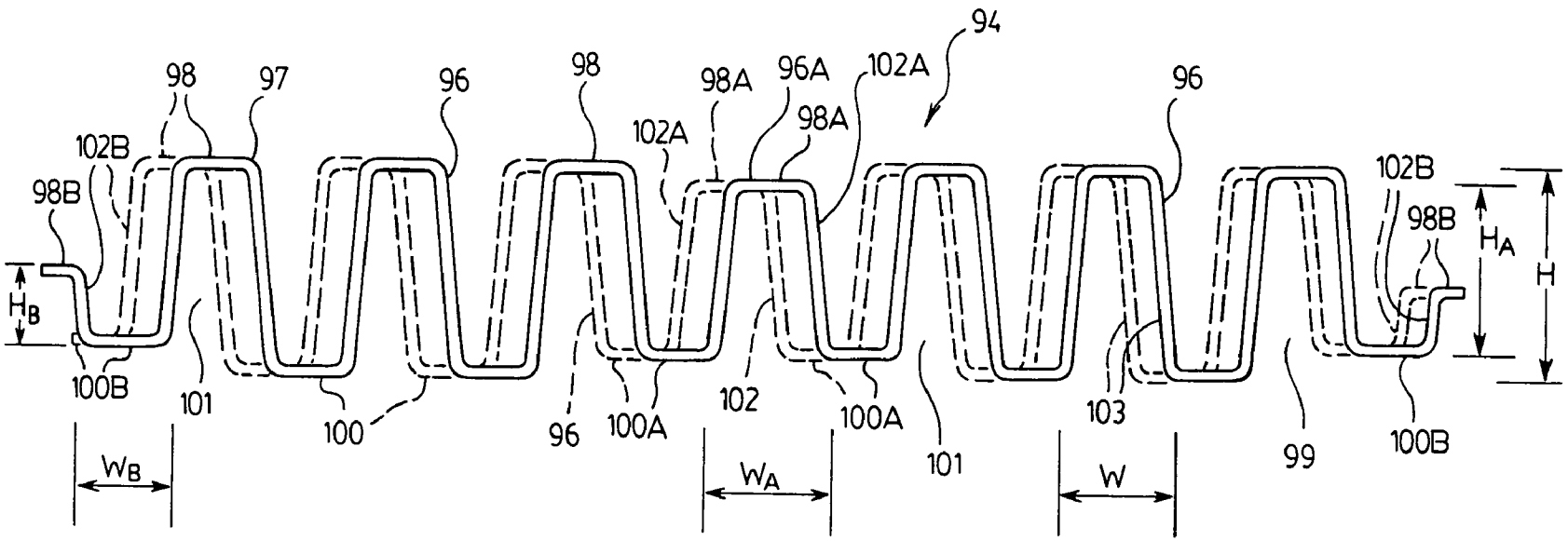
FIG. 10 is a front view of the turbulizer of FIG. 9, showing the relative orientations of overlapping convolutions in two adjacent rows.

FIG. 9 illustrates a portion of another preferred plate pair 70 according to the invention, incorporating a turbulizer 94, and FIG. 10 illustrates a portion of turbulizer 94 in isolation. Plate pair 70 is constructed from first and second U-shaped plates 72 and 74. The first U-shaped plate 72 has a pair of straight parallel side portions 76 and 78 (also referred to herein as "legs") joined by a curved portion 80 (also referred to herein as a "bight portion"). The second U-shaped plate 74 similarly has substantially straight, parallel side portions 82 and 84 joined by a curved portion 86. The side portions 82 and 84 of the second U-shaped plate 74 are provided with shoulders 88 and 90 which engage the inner surfaces of side portions 76 and 78 of the first U-shaped plate 72. The engagement of shoulders 88 and 90 with the side portions 76 and 78 provides a mechanical connection between the plates 72 and 74 and also provides surfaces along which the plates 72 and 74 can be joined, for example by brazing.

It will be appreciated that both shoulders 88 and 90 are not necessarily provided on same U-shaped plate section, but rather each U-shaped plate section may be provided with one shoulder on one of its side portions.

The plate pair 70 defines a fluid flow passage 92 in which a turbulizer 94 is provided. The turbulizer 94 comprises an offset strip fin similar to strip fins 33, 48, 58 and 60 described above. Turbulizer 94 comprises a plurality of convolutions 96 disposed in a plurality of transverse rows, of which only two rows 97, 99 are shown in FIGS. 9 and 10. The convolutions 96 comprise top surface portions 98 and bottom surface portions 100 which are more rounded than the top and bottom surface portions of the turbulizers described above, but which have flat portions for engaging the side portions 76, 78, 82, 84 of the plates 72, 74. The convolutions 96 further comprise side portions 102 which interconnect the top and bottom surface portions 98, 100. In turbulizer 94 the side portions 102 are sloped rather than vertical as in the turbulizers described above. It will be appreciated that the convolutions 96 of turbulizer 94 do not necessarily have the shape shown in FIGS. 9 and 10, but may have an alternate shape. For example, they may be rectangular as in the turbulizers described above.

Convolutions 96 define apertures or flow passageways 101 opening in a direction transverse to the direction of the rows 97, 99. When a fluid such as oil flows through the flow passage 46 defined by plate pair 44, it will periodically encounter leading edges 103 associated with convolutions 96.

The turbulizer 94 includes convolutions 96 of varying height. More specifically, each row includes a first plurality of convolutions 96 of width W and height H, wherein height H is substantially the same as the maximum height of the fluid flow passage 92 between the side walls of the plates 72 and 74.

The first plurality of convolutions 96 comprises two groups which are separated by at least one convolution 96A having a width $W_A$ the same as height W and a height $H_A$ which is less than height H. Height $H_A$ is substantially the same as the height of the flow passage 94 at the point where the first and second U-shaped plates 72 and 74 are joined, i.e. between shoulders 88 and 90. The convolutions 96A comprise top surface portions 98A, bottom surface portions 100A and side portions 102A. In the preferred embodiment shown in the drawings, the side portions 102A are shorter than side portions 102 of convolutions 96, while the top and bottom surface portions 98A, 100A are same width as the top and bottom surface portions 98 of convolutions 96. In addition, the top surface portions 98A are reduced in height relative to the top surface portions 98 while the bottom surface portions 100A are elevated relative to bottom surface portions 100.

Located at either end of each row 97, 99 is at least one convolution 96B having a width $W_B$ which is the same as width W and height $H_B$ which is less than heights H and $H_A$. The convolutions 96B have side portions 102B which are shorter than side portions 102 and 102A and have top and bottom surface portions 98B, 100B which are the same with as top and bottom surface portions 98, 100. In addition, the bottom surface portions 100B and 100A are coplanar while the top surface portions 98B are reduced in height relative to the top surface portions 98 and 98A of convolutions 96 and 96A. It will be appreciated that convolutions 96B extend into the areas of reduced height adjacent to the edges of flow passage 92.

In the embodiments of the invention described above, the turbulizers are positioned in the fluid flow passages in the low pressure drop orientation, i.e. with the rows of convolutions disposed transverse to the flow direction and transverse to the longitudinal axis of the plate pair. The present invention also includes embodiments in which the turbulizers are arranged in the high pressure drop orientation, in which the rows of convolutions are disposed parallel to the flow direction and parallel to the longitudinal axis of the plate pair. These embodiments are now described below.

FIGS. 11 to 14 illustrate another preferred embodiment of the invention utilizing a turbulizer 120 comprising a plurality of convolutions 124, 134 disposed in rows 122 extending along longitudinal axis L, which is parallel to the direction of fluid flow.

A first plurality of rows 122, spaced from the longitudinal edges of turbulizer 120, is comprised of generally sinusoidal-shaped convolutions 124 having a first height H. Convolutions 124 comprise smoothly curved top and bottom surface portions 126, 127 connected by sloping side portions 128. The sloping side portions 128 are interrupted at about their midpoints by shoulders 130 through which adjacent rows 122 are connected together. These shoulders 130 are interconnected to form continuous lines 132 extending transversely across the turbulizer 120.

Figure 13:
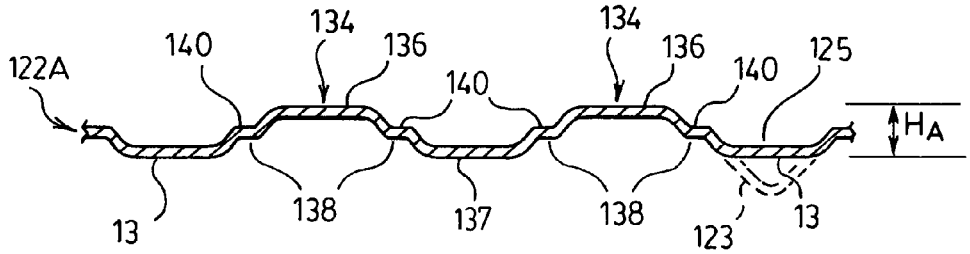
FIG. 13 is a cross sectional side view of one row of the turbulizer of FIG. 11, taken along line 13-13 of FIG. 11.

The turbulizer 120 also includes a plurality of rows 122, labelled 122A, comprised of convolutions 134 which are of a somewhat reduced height $H_A$ relative to the convolutions 124. These rows 122A extend along the longitudinal edges of the turbulizer 120. A cross sectional view through a portion of a row 122A of reduced height convolutions 134 is shown in FIG. 13. As shown, the convolutions 134 are comprised of flat top and bottom surface portions 136, 137 which are connected by sloping side portions 138. The side portions 138 are interrupted by shoulders 140 which are relatively wider than shoulders 130 of convolutions 124 and through which the convolutions 134 at the edges of the turbulizer strip 120 are connected to convolutions 124 in neighbouring rows.

The convolutions 124, 134 define apertures or flow passageways 125 open in a direction transverse to the direction of rows 122 and transverse to the flow direction. When a fluid such as oil flows through the turbulizer 120 by following a tortuous path through the transverse openings between convolutions of adjacent rows 122, it will periodically encounter the side portions 128, 138 of the convolutions 124, 134. This orientation is referred to as the high pressure drop orientation.

Figure 14:
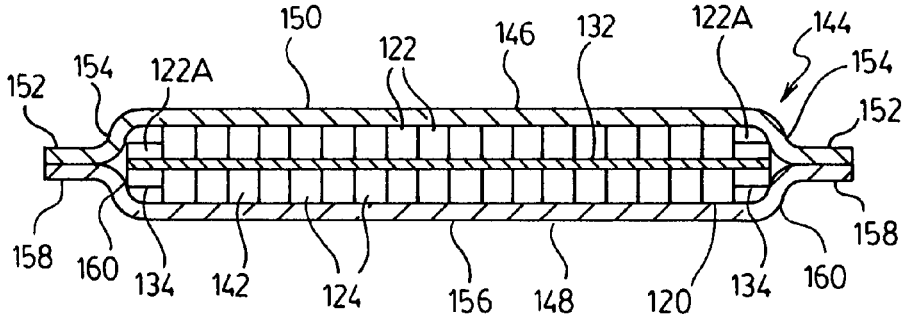
FIG. 14 is a cross sectional end view through a first plate pair including the turbulizer strip of FIGS. 11 to 13.

FIG. 14 illustrates a turbulizer strip 120 located in the fluid flow passage 142 of a plate pair 144 which is comprised of upper and lower plates 146, 148 and is generally of the same shape as prior art plate pair 61 shown in FIG. 1. The cross section of FIG. 14 is taken in a transverse plane through the continuous line 132 formed by the shoulders of the convolutions 124, 134. The plates 146, 148 are arranged back-to-back and have joined peripheral flanges 152, 158. Plates 146, 148 also have raised central portions 150, 156 which are connected to flanges 152, 158 through sloping, rounded side walls 154, 160. Due to the presence of sloping, rounded side walls 154, 160, the fluid flow passage 142 of plate pair 144 has a central portion having a height which is equal to the distance between the central raised portions 150, 156 of the plates 146 and 148. The area approaching the flanges 152, 158 is gradually reduced in height.

As mentioned above, the turbulizer 120 is positioned in the fluid flow passage 142 in the high pressure drop orientation. The rows 122 having convolutions 124 of height H are located between and in contact with the central raised portions 150, 156 of the plates 146, 148. The rows 122A along the edges of turbulizer strip 120 having convolutions 134 of height $H_A$ are located adjacent the edges of the fluid flow passage 142, i.e. adjacent to flanges 152, 158. In order to minimize the bypass area adjacent the edges of the flow passage 142, it is preferred that the reduced height convolutions 134 make at least some contact with the upper and lower plates 146 and 148, as shown in FIG. 14. However, due to the curved shape of the edges of flow passage 142 and the square shape of the convolutions, it will be appreciated that complete contact with the plates 146 and 148 is not possible.

Figure 15:
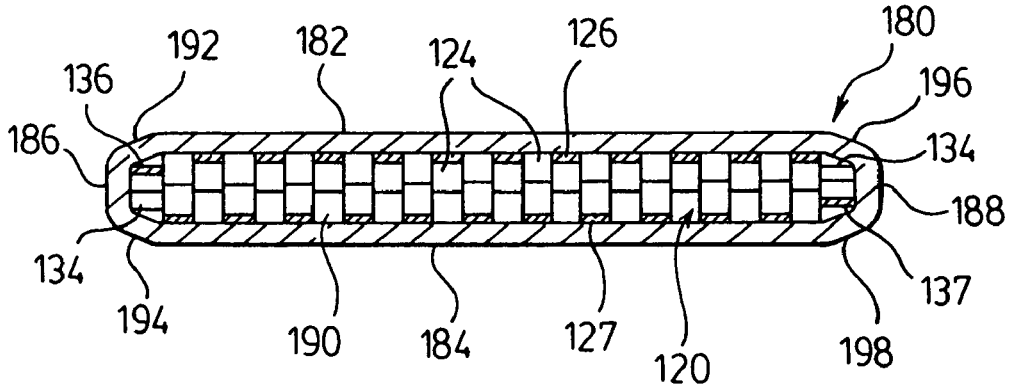
FIG. 15 is a cross sectional end view through a second plate pair including the turbulizer strip of FIGS. 11 to 13.
Figure 16:
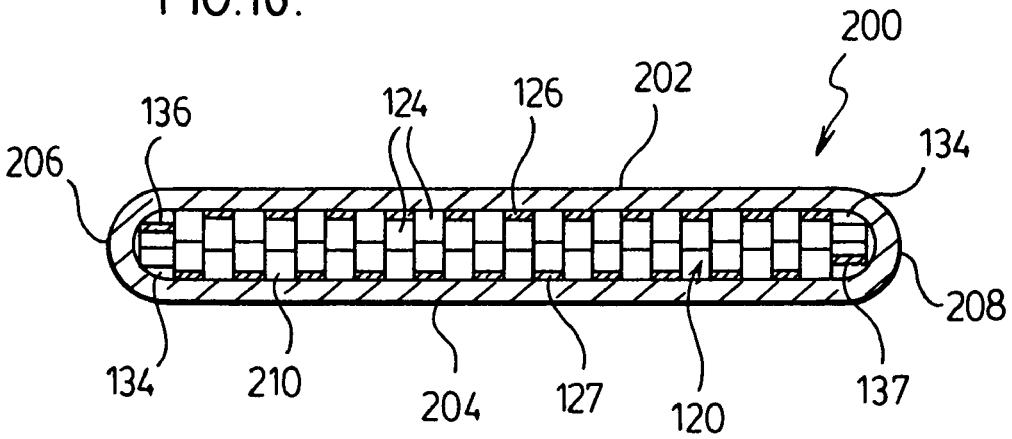
FIG. 16 is a cross sectional end view through a third plate pair including the turbulizer strip of FIGS. 11 to 13.

FIGS. 15 and 16 show that the turbulizer 120 can be used in heat exchangers formed from flat, extruded tubes of varying shapes, rather than the plate pairs described above. The cross sections of FIGS. 15 and 16 are taken in a transverse plane through the top and bottom surface portions of convolutions 124, 134.

In FIG. 15, the turbulizer 120 is disposed in the high pressure drop orientation in a flat heat exchange tube 180 having flat, parallel top and bottom walls 182, 184 and substantially vertical side walls 186, 188. Together, the walls 182, 184, 186, 188 define a fluid flow passage 190. The top, bottom and side walls are connected together by angled transitions 192, 194, 196 and 198 which reduce the height of the flow passage 190 adjacent to its outer edges. It will be seen that the reduced height convolutions 134 of turbulizer 120 fill a large portion of the area located between angled transitions 192 and 194 and the area located between angled transitions 196 and 198, thereby substantially reducing bypass flow through the tube 180.

In FIG. 16, the turbulizer 120 is disposed in the high pressure drop orientation in a flat heat exchange tube 200 having flat, parallel top and bottom walls 202, 204 connected by rounded side portions 206, 208. Together, the walls 202, 204 and side portions 206, 208 define a fluid flow passage 210. The height of the flow passage 210 is reduced within the rounded side portions 206, 208. It will be seen that the reduced height convolutions 134 of turbulizer 120 fill a large portion of the area located within the rounded side portions 206, 208, thereby substantially reducing bypass flow through the tube 200.

Figure 11:
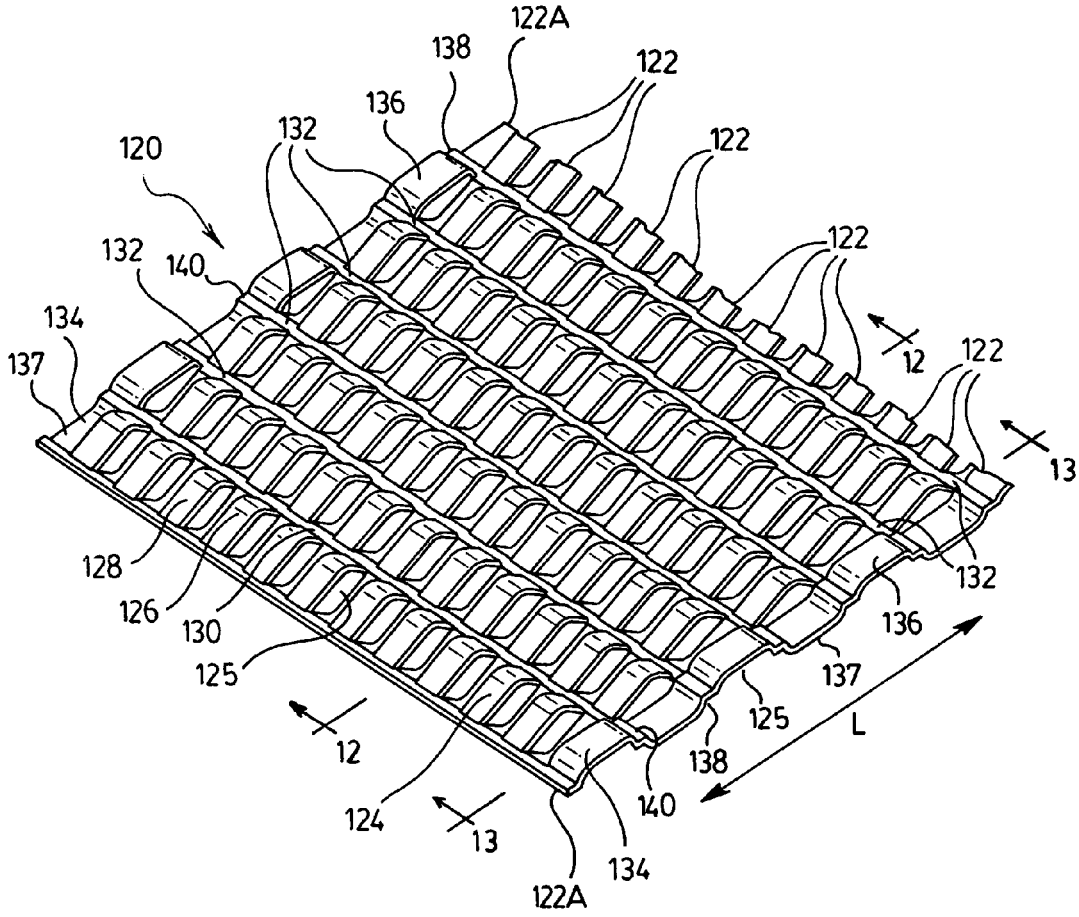
FIG. 11 is a perspective view of a portion of a turbulizer according to another preferred embodiment of the invention.
Figure 12:
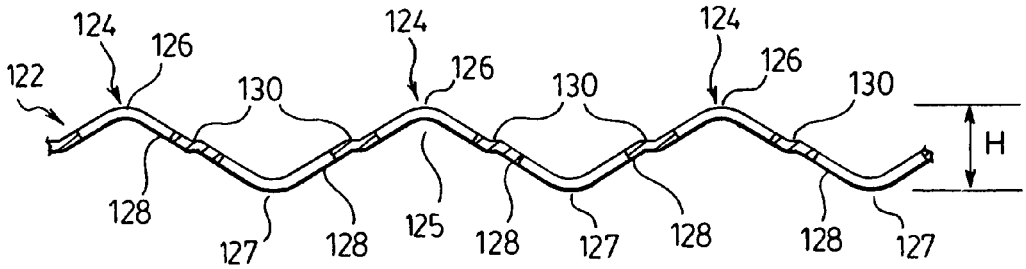
FIG. 12 is a cross sectional side view of one row of the turbulizer of FIG. 11, taken along line 12-12 of FIG. 11.

In the turbulizer 120 shown in FIGS. 11 to 13, the flat top portions 136 of the reduced height convolutions 134 are reduced in height relative to the top portions 126 of the full-height convolutions 124 and the flat bottom portions 137 of the reduced-height convolutions 134 are elevated relative to the bottom portions 127 of the full-height convolutions 124. Thus, the turbulizer 120 is particularly useful in heat exchange tubes or plate pairs such as those shown in FIGS. 14 to 16 in which the top and bottom walls of the tube or plate pair converge toward a central plane.

It will however be appreciated that the turbulizer 120 could be modified for use in a tube or plate pair similar or identical to those shown in FIGS. 4 and 4A where the bottom wall of the tube or plate pair is flat and the top wall of the tube or plate pair converges toward the bottom wall adjacent its edges. Specifically, the turbulizer 120 could be modified so that the bottom portions 137 of the reduced-height convolutions 134 are coplanar with the bottom portions 127 of the full-height convolutions 124. For example, the lower portions of the reduced height convolutions 134 (below shoulders 140) could have the same or similar sinusoidal shape and height as the full height convolutions 124. This possibility is illustrated by dotted line portion 123 in the cross section of FIG. 13.

Figure 17:
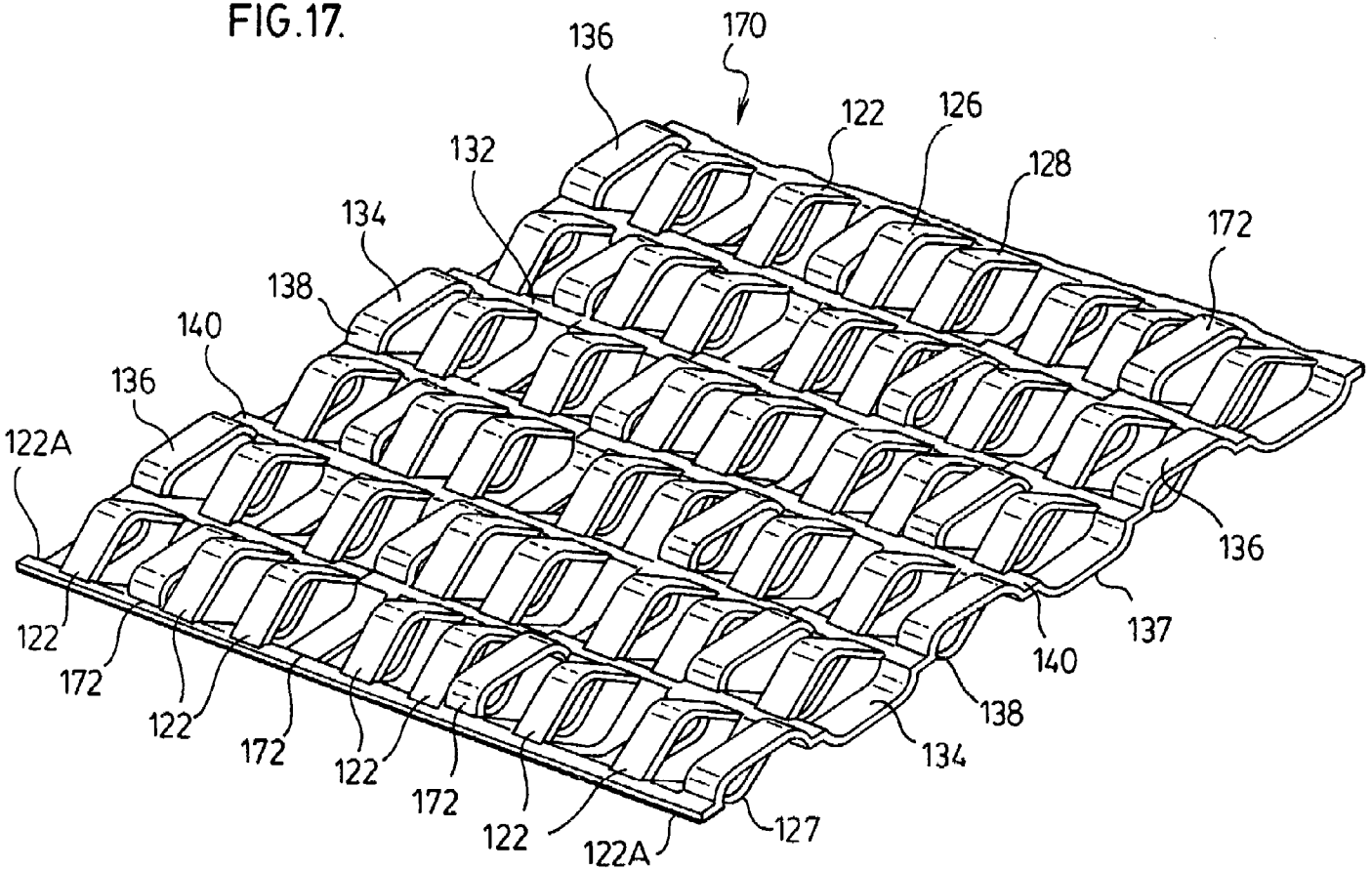
FIG. 17 is a perspective view of a portion of a turbulizer strip according to another preferred embodiment of the invention.

FIG. 17 illustrates another preferred turbulizer 170 for use in heat exchangers according to the invention. Turbulizer 170 is similar in a number of respects to turbulizer 120 shown in FIGS. 11 to 13, and like reference numerals are used to identify like components in the turbulizer of FIG. 17. Turbulizer 170 comprises a plurality of rows 122 of convolutions. Some of these rows 122 are comprised of full height convolutions 124 which are spaced inwardly from the edges of the turbulizer strip 170. The turbulizer strip 170 also includes a number of rows 122, labelled 122A, comprised of reduced height convolutions 134. Rows 122A are located along the longitudinally extending edges of turbulizer strip 170. In the embodiment of FIG. 17, there is one row 122 of reduced height convolutions 134 along each edge of the turbulizer strip 170. The convolutions 124 and 134 of turbulizer strip 170 are exactly the same as in turbulizer 120 and therefore further discussion of these convolutions is not necessary. Turbulizer 170 is preferably disposed in a plate pair or extruded heat exchanger tube in a high pressure drop orientation as shown in FIGS. 14 to 16, that is with rows 122 extending transverse to the direction of fluid flow.

In addition, the turbulizer 170 of FIG. 17 is provided with spaced apart rows 172 which are comprised of reduced height convolutions 174. Rows 172 are located between the rows of full height convolutions 122. Convolutions 174 may preferably have the same shape and dimensions as convolutions 134 shown in FIG. 13, although this is not necessary. The rows 172 comprised of reduced height convolutions 174 provide pressure recovery zones to avoid excessive pressure drop as the fluid flows through the turbulizer 170 in the high pressure drop orientation.

Although the preferred plate pairs 44, 44' and 70 shown in FIGS. 4, 4A and 9 are shown in the drawings as being provided with turbulizers arranged in the low pressure drop orientation, it will be appreciated that these and similar plate configurations can be used in combination with turbulizers arranged in the high pressure drop orientation, such as the turbulizers shown in FIGS. 11 to 13 and 17. For example, the turbulizer 170 shown in FIG. 17 could be used in a plate pair 70 as shown in FIG. 9. To fit within the flow passage of plate pair 70, the turbulizer 170 would be provided with at least one row 122 of reduced height convolutions 134 along each of its edges and would be provided with at least one row 172 of reduced height convolutions 174 to fit between the shoulders 88 and 90 formed in the overlapping end portions of the U-shaped plates.

Although the invention has been described in connection with certain preferred embodiments, it is not restricted thereto. Rather, the invention includes all embodiments which may fall within the scope of the following claims.

The invention claimed is:

1. A heat exchanger comprising:

(a) at least one heat exchange tube defining a hollow fluid flow passage, wherein the flow passage has a height and a width and extends longitudinally along a fluid flow axis, wherein the height of the flow passage varies across its width, wherein the flow passage comprises at least one full-height area in which the height of the flow passage is at a maximum and at least one reduced-height area in which the height of the flow passage is less than the maximum height of the flow passage, and wherein the full-height and reduced-height areas are located adjacent to one another;

(b) a turbulizer received inside the fluid flow passage, wherein the turbulizer comprises a plurality of rows of convolutions, wherein adjacent ones of said rows are connected in side-by-side parallel relation to one another, wherein the convolutions of each said row comprise a series of top surface portions and bottom surface portions interconnected by side portions, and wherein the rows extend parallel to the fluid flow axis;

wherein at least two adjacent rows are comprised of convolutions of different heights, including at least one row of full-height convolutions positioned in the full-height area of the fluid flow passage and having a height substantially the same as the maximum height of the flow passage, and including at least one row of reduced-height convolutions positioned in the reduced-height area of the fluid flow passage and having a maximum height which is less than the maximum height of the flow passage and less than the height of the full-height convolutions; and wherein the top and bottom surface portions of the full-height convolutions are rounded and the top and bottom surface portions of the reduced-height convolutions are flat.

2. The heat exchanger of claim 1, wherein all the convolutions of each row are of the same height.

3. The heat exchanger of claim 1, wherein the flow passage includes one said full-height area located centrally in the flow passage, wherein the flow passage includes two of said reduced-height areas located at opposite edges of the flow passage; and wherein the turbulizer comprises at least one row of said reduced-height convolutions along each of its edges, and wherein the rows of said reduced-height convolutions are separated by a plurality of rows of said full-height convolutions.

4. The heat exchanger of claim 1, wherein the flow passage includes one of said reduced-height areas located between opposite edges of the flow passage, wherein the flow passage includes two of said full-height areas located adjacent to said reduced-height area; and wherein the turbulizer includes at least one row of said reduced-height convolutions and includes a plurality of rows of said full-height convolutions on either side of the row of reduced-height convolutions.

5. The heat exchanger of claim 4, wherein the flow passage further includes a pair of reduced-height areas located at opposite edges of the flow passage, each of which is located adjacent one of the full-height areas; and wherein the turbulizer further includes at least one row of said reduced-height convolution along each of its edges and adjacent to one of the full-height areas.

6. The heat exchanger of claim 1, wherein the top and bottom surface portions of the full-height and reduced-height convolutions are in contact with the plates.

7. The heat exchanger of claim 1, wherein the top surface portions of the convolutions in each row are longitudinally aligned with the bottom surface portions of the convolutions in an adjacent row.

* * * * *